United States Patent [19]

Ichihashi et al.

[11] Patent Number: 4,776,967

[45] Date of Patent: Oct. 11, 1988

[54] LUBRICATING OIL COMPOSITION

[75] Inventors: Toshihiko Ichihashi; Yoshitaka Tamoto, both of Sodegaura, Japan

[73] Assignee: Idemitsu Kosan Company Limited, Tokyo, Japan

[21] Appl. No.: 154,796

[22] Filed: Feb. 11, 1988

[30] Foreign Application Priority Data

Feb. 27, 1987 [JP] Japan ..... 62-42741
Feb. 27, 1987 [JP] Japan ..... 62-42742

[51] Int. Cl.[4] ..... C10M 145/14; C10M 157/10

[52] U.S. Cl. ..... 252/32.7 E; 252/56 R; 252/49.6; 252/49.7; 252/52 R; 252/50

[58] Field of Search ..... 252/32.7 E, 49.6, 51.5 A, 252/56 R, 58, 49.7, 52 R

[56] References Cited

U.S. PATENT DOCUMENTS

| | | | |
|---|---|---|---|
| 3,598,736 | 8/1971 | Van der Meij et al. | 252/56 R |
| 3,869,396 | 3/1975 | Van de Kraats et al. | 252/56 R |
| 3,897,353 | 7/1975 | Morduchowitz et al. | 252/56 R |
| 4,146,492 | 3/1979 | Cusano et al. | 252/56 R |
| 4,149,984 | 4/1979 | Wenzel et al. | 252/56 R |

*Primary Examiner*—Jacqueline V. Howard

*Attorney, Agent, or Firm*—Frishauf, Holtz, Goodman & Woodward

[57] ABSTRACT

The present invention relates to a lubricating oil composition comprising:

(A) a mineral oil having a kinematic viscosity at 100° C. of 1 to 50 centistokes and a viscosity index of at least 60, (B) 0.5 to 20% by weight based on the total weight of the composition of an ethylene-α-olefin copolymer having a number average molecular weight of 800 (inclusive) to 5,000 (exclusive), (C) 0.05 to 20% by weight based on the total weight of the composition of polymethacrylate having a number average molecular weight of 10,000 to 250,000 or a mixture of said polymethacrylate and an olefin copolymer, and (D-I) 1 to 20% by weight based on the total weight of the composition of a detergent-dispersant and/or an antioxidant, or (D-II) 0.5 to 20% by weight based on the total weight of the composition of at least one member selected from the group consisting of a extreme pressure agent, an anti-wear agent and an oiliness agent.

According to the present invention, a multi grade lubricating oil composition which is excellent in shear stability can be obtained.

21 Claims, No Drawings

LUBRICATING OIL COMPOSITION

BACKGROUND OF THE INVENTION

The present invention relates to a lubricating oil composition and more particularly to a multi grade lubricating oil composition which is excellent in shear stability.

One embodiment of the present invention relates to a multi grade engine oil composition and more particularly to a multi grade engine oil composition which is excellent in shear stability and engine cleanliness. This multi grade engine oil composition can be used as an internal combustion engine oil for a gasoline engine, a diesel engine, a gas engine and other special engine, and further as a compressor oil. Another embodiment of the present invention relates to a high viscosity index lubricating oil composition containing a mineral oil as a major component, and more particularly to a lubricating oil composition which has a particularly high viscosity index, is excellent in shear stability and further in extreme pressure properties and anti-wear properties, and thus which can be used as an oil for cars and industrial gears, a power stearing oil, a tractor oil, a shock absorber oil, a hydraulic fluid, a door check oil, a bearing oil and so on.

The conventional multi grade engine oils have a disadvantage in that their viscosity is markedly decreased by mechanical shear applied thereto during their use, because they contain a relatively large amount of a polymer having a greatly high molecular weight as an agent to improve viscosity-temperature characteristics (a viscosity index improver). Particularly under high oil temperatures, the reduction in viscosity is great and the problem of abrasion of bearing metal often occurs. Moreover, addition of a large amount of the polymer leads to a reduction in engine cleanliness and particularly, to increase the engine deposits.

On the other hand, a mineral oil with high molecular weight polymers compounded thereto has heretofore been used as a high viscosity index lubricating oil.

However, since this lubricating oil contains a relatively large amount of high molecular weight polymers, its shear stability is seriously poor; when subjected to mechanical shear, it suffers from disadvantages in that viscosity is markedly decreased, initial performance cannot be satisfied, and abrasion is increased. Thus the lubricating oil is unsuitable for practical use.

SUMMARY OF THE INVENTION

One embodiment of the present invention is intended to overcome the above prior art problems and an object of the present invention is to provide a multi grade engine oil composition which is excellent in shear stability and also in engine cleanliness.

That is, one embodiment of the present invention provides a lubricating oil composition comprising:

(A) a mineral oil having a kinematic viscosity at 100° C. of 0.5 to 50 centistokes and a viscosity index of at least 60, (B) 0.5 to 20% by weight based on the total weight of the composition of an ethylene-α-olefin copolymer having a number average molecular weight of 800 (inclusive) to 5000 (exclusive), (C) 0.05 to 20% by weight based on the total weight of the composition of polymethacrylate having a number average molecular weight of 10,000 to 250,000 or a mixture of said polymethacrylate and an olefin copolymer, and (D-I) 1 to 20% by weight based on the total weight of the composition of a detergent-dispersant and/or an anti-oxidant.

Another embodiment of the present invention is intended to overcome the above problems and an object of the present invention is to provide a lubricating oil composition which has a high viscosity index and which is excellent in shear stability and further in extreme pressure and anti-wear properties. In another embodiment of the present invention a lubricating oil composition comprising:

(A) a mineral oil having a kinematic viscosity at 100° C. of 0.5 to 50 centistokes and a viscosity index of at least 60, (B) 0.5 to 20% by weight based on the total weight of the composition of an ethylene-α-olefin copolymer having a number average molecular weight of 800 (inclusive) to 5000 (exclusive), (C) 0.05 to 20% by weight based on the total weight of the composition of polymethacrylate having a number average molecular weight of 10,000 to 250,000 or a mixture of said polymethacrylate and an olefin copolymer, and (D-II) 0.5 to 20% by weight based on the total weight of the composition of at least one member selected from the group consisting of a extreme pressure agent, an antiwear agent and an oiliness agent.

DETAILED DESCRIPTION OF THE INVENTION

In the present invention, as the component (A), a mineral oil having a kinematic viscosity at 100° C. of 0.5 to 50 centistokes (cSt) and a viscosity index of at least 60, preferably at 80 is used.

Especially, in one embodiment of the present invention, as the component (A), mineral oil having a kinematic viscosity at 100° C. of 1 to 50 cSt, preferably 2 to 35 cSt is used. In another embodiment of the present invention, as the component (A), mineral oil having a kinematic viscosity at 100° C. of 1 to 40 cSt is more preferable. The pour point of the mineral oil is not more than −5° C. and preferably not more than −10° C. This mineral oil is a base of the lubricating oil composition of the present invention. If the kinematic viscosity of the mineral oil is less than 1 cSt, evaporation loss is large, which is unsuitable for practical use. On the other hand, it is in excess of 50 cSt, the viscosity at low temperatures is high, which is unsuitable for the multi grade oil. If the viscosity index of the mineral oil is less than 60, the effect of increasing the viscosity index is poor and thus a large amount of a polymer is needed, which is undesirable because of a reduction in second performance. This mineral oil is obtained by the known lubricating oil purification methods, for example, by purifying a lubricant fraction obtained by ordinary distillation or vacuum distillation, by techniques such as solvent purification and hydrogenation purification. More specifically, fractions such as 70 Neutral, 100 Neutral, 150 Neutral, 300 Neutral, 500 Neutral, Bright Stock, and mixtures of the fractions can be used.

In the present invention, as the component (A), a synthetic oil can be used in place of the above mineral oil. However, since the synthetic oil is low in an ability to dissolve additives, exerts adverse influences on anti-sealing properties and is expensive, it is prefered to be used in combination with a mineral oil.

In the present invention, as the component (B), an ethylene-α-olefin copolymer having a number average molecular weight of 800 (inclusive) to 5,000 (exclusive) and preferably 2,000 to 4,000 (both inclusive) is used. If the number average molecular weight of the ethylene-α-olefin copolymer is less than 800, the effect of increasing the viscosity index is poor. On the other hand, it is in excess of 5,000, the shear stability is undesirably reduced. This ethylene-α-olefin copolymer is a cooligmmer of ethylene and α-olefin having 3 to 20 carbon atoms, such as propylene, 1-butene and 1-decene, and is a hydrocarbon-based synthetic oil not having a polar group. The above component (B) is compounded in a proportion of 0.5 to 20% by weight based on the total weight of the composition. If the proportion of the component (B) compounded is less than 0.5% by weight, the effect of increasing the viscosity index is undesirably poor. On the other hand, if it is in excess of 20% by weight, the viscosity at low temperatures is increased and the object of the multi grade cannot be attained.

Especially, in one embodiment of the present invention, component (B) is preferably compounded in aproportion of 1 to 15% by weight and more preferably 1 to 10% by weight based on the total weight of the composition. In another, embodiment of the present invention, component (B) is compounded in a proportion of 2 to 20% by weight and preferably 3.0 to 15% by weight based on the total weight of the composition.

In the present invention, as the component (C), polymethacrylate having a number average molecular weight of 10,000 to 250,000, preferably 20,000 to 200,000 is used. If the number average molecular weight is less than 10,000, the viscosity index is not increased. On the other hand, it is in excess of 250,000, the shear stability is undesirably reduced.

The component (C) is compounded in a proportion of 0.05 to 20% by weight, by weight based on the total weight of the composition. If the proportion of the component (C) compounded is less than 0.05% by weight, low temperature fluidity is undesirably low. On the other hand, it is in excess of 20% by weight, shear stability and engine cleanliness are undesirably reduced or the viscosity at low temperature is high. The component (C) acts to increase the viscosity index of the lubricating oil composition and to lower the pour point thereof.

Especially, in one embodiment of the present invention, component (C) is preferably compounded in aproportion of 0.1 to 10% by weight base on the total weight of the composition. In another embodiment of the present invention, component (C) is preferably compounded in a proportion of 0.1 to 15% by weight based on the total weight of the composition.

In combination with the polymethacrylate, an olefin copolymer having a number average molecular weight of 10,000 to 250,000, preferably 50,000 to 200,000 can be used as the component (C) of one embodiment of the present invention. Use of the olefin copolymer in combination increases the engine cleanliness.

Examples of the olefin copolymer include an ethylene-propylene copolymer and an ethylene-styrene copolymer.

In the present invention, as the component (D), component (D-I) or component (D-II) is used.

That is, in one embodiment of the present invention, as the component (D-I), a detergent-dispersant and/or an antioxidant is used.

As the detergent-dispersant, sulphonates such as calcium sulphonate and magnesium sulphonate, phenates, salycilates, succinimide (alkenyl or alkyl succinimide), acid amides, benzylamine, succinic acid esters, and the like can be used.

As the antioxidant, phenol-based antioxidants such as 2,6-di-tert-butyl, 4-methyl phenol; amine-based antioxidants such as dioctyldiphenylamine; zinc dithiophosphate (ZnDTP); and the like can be used.

In one embodiment of the present invention, as the component (D-I), any one of the above detergent-dispersant and antioxidant is used, or they are used in combination. Preferred examples of the component (D-I) are calcium sulphonate, magnesium sulphonate, phenate, succinimide and zinc dithiophosphate (ZnDTP). It is particularly preferred that ZnDTP and sulphonate and/or phenate and succinimide be compounded.

The component (D-I) is compounded in a proportion of 1 to 20% by weight, preferably 3 to 15% by weight based on the total weight of the composition. If the proportion of the component (D-I) compounded is less than 1% by weight, engine cleanliness are undesirably reduced. On the other hand, if it is in excess of 20% by weight, engine cleanliness are also undesirably reduced.

In another embodiment of the present invention, as the component (D-II), at least one member selected from the group consisting of a extreme pressure agent, an anti-wear agent and an oiliness agent is used.

As the extreme pressure agent, various compounds can be used. More specifically, sulfur-containing extreme pressure agents such as sulfides, sulfoxides, sulfones, thiosulfinates, thiocarbonates, olefinic sulfides, sulfurized fats and oils; phosphorus-containing extreme pressure agents such as phosphoric acid esters, phosphorous acid esters, and phosphoric acid ester amine salts; halogen-containing extreme pressure agents such as chlorinated hydrocarbons; organic metal-containing extreme pressure agents such as thiophosphoric acid salts, e.g., zinc dithiophosphate, and thiocarbamic acid salts; and the like can be used.

As the anti-wear agent, organomolybdenum compounds such as MoDTP and MoDTC; organoboric compounds such as alkylmercaptyl borate; solid lubricant-based anti-wear agents such as graphite, molybdenum disulfide, antimony sulfide, boron compounds and polytetrafluoroethylene; and the like can be used.

As the oiliness agent, higher fatty acids such as oleic acid and stearic acid; higher alcohols such as oleyl alcohol; amines; esters; chlorinated fats and oils; and the like can be used.

In another embodiment of the present invention, as the component (D-II), a extreme pressure agent, an anti-wear agent and an oiliness agent as described above are used alone or as mixtures comprising two or more thereof. As the component (D-II), sulfur-containing extreme pressure agents such as sulfurized fats and oils, and olefinic sulfide, phosphorus-containing extreme pressure agents such as phosphoric acid esters, phosphorous acid esters and their amine salts, and zinc dithiophosphate, Mo compounds such as MoDTP and MoDTC, and boron compounds are preferably used alone or as mixtures comprising two or more thereof.

The component (D-II) is compounded in a proportion of 0.5 to 20% by weight, preferably 0.5 to 10% by weight based on the total weight of the composition. If the proportion of the component (D-II) compounded is less than 0.5% by weight, extreme pressure and antiwear properties are undesirably low. On the other hand, if it is in excess of 20% by weight, corrosion is sometimes caused.

The lubricating oil composition of the present invention contains the components (A) to (D) as described above. In addition, if necessary, the lubricating oil composition may contain additives such as a defoaming agent, a rust preventing agent, a corrosion inhibitor and a color additive.

As the defoaming agent, silicone-based defoaming agents such as dimethylsiloxane and a silica gel dispersion; alcohol-based defoaming agents; ester-based defoaming agents; and the like can be used.

As the rust-preventing agent, carboxylic acids, carboxylic acid salts, sulfonic acid salts, esters, phosphoric acid, phosphoric acid salts, and the like can be used.

As the corrosion inhibitor, benzotriazole and its derivatives, thiazole compounds and the like can be used.

The composition of one embodiment of the present invention is excellent in shear stability. Moreover, the composition of the present invention is excellent in engine cleanliness.

Accordingly the composition of one embodiment of the present invention can be used as a multi grade engine oil composition for various internal combustion engines.

In accordance with another embodiment of the present invention, there can be obtained a lubricating oil composition having a viscosity index of at least 140 and a high viscosity index.

Moreover, the lubricating oil composition of another embodiment of the present invention has a pour point of not more than −30° C. and a Brookfield viscosity at −26° C. of not more than 150,000 cp, and thus it is excellent in low temperature characteristics.

Furthermore, the lubricating oil composition of another embodiment of the present invention is excellent in shear stability and also in extreme pressure properties.

Accordingly the lubricating oil composition of another embodiment of the present invention can be used as an oil for car and industrial gears, a power stearing oil, a tractor oil, a shock absorber oil, a hydraulic fluid, a door check oil, a bearing oil and so on.

The following examples are given to illustrate the present invention, although the present invention is not limited thereto.

EXAMPLES 1 TO 3 AND COMPARATIVE EXAMPLES 1 TO 2

The engine oil compositions shown in Table 1 (prepared according to SAE viscosity grade 5W/30) were subjected to various tests and their physical properties were evaluated. The results are shown in Table 1.

EXAMPLES 4 TO 5 AND COMPARATIVE EXAMPLES 3 TO 4

The engine oil compositions shown in Table 2 (prepared according to SAE viscosity grade 10W/30) were subjected to various tests and their physical properties were evaluated in the same manner as in Examples 1 to 3 and Comparative Examples 1 to 2. The results are shown in Table 2.

TABLE 1

| | | Example | | | Comparative Example | |
|---|---|---|---|---|---|---|
| | | 1 | 2 | 3 | 1 | 2 |
| Composition (wt %) | | | | | | |
| Component (A) | Mineral oil I*1 | 78.1 | 77.1 | 62.4 | 79.2 | 13.7 |
| | Mineral oil II*2 | 10 | 10 | 25 | 10 | 75 |
| Component (B) | Ethylene-α-olefin copolymer I*3 | 1.5 | — | 1.5 | — | — |
| | Ethylene-α-olefin copolymer II*4 | — | 2.5 | — | — | — |
| Component (C) | Polymethacrylate I*5 | — | — | 2.1 | — | 2.3 |
| | Polymethacrylate II*6 | 0.3 | 0.3 | — | 0.3 | — |
| Component (D-I) | Package DI*7 | 9.0 | 9.0 | 9.0 | 9.0 | 9.0 |
| Olefin Copolymer*8 | 1.1 | 1.1 | — | 1.5 | — | |
| Properties | | | | | | |
| Kinematic Viscosity @ 100° C. (cSt)*9 | | 9.5 | 9.7 | 9.5 | 9.7 | 9.6 |
| CCS Viscosity @ −25° C. P*10 | | 32 | 34 | 32 | 30 | 32 |
| Supersonic Shear Stability Test*11 Rate of Reduction in Viscosity (%) @ 100° C. | | 14 | 14 | 25 | 17 | 28 |
| HT/HS Viscosity @ 150° C. cp*12 | | 3.1 | 3.1 | 2.9 | 3.0 | 2.8 |
| Panel Coaking Test*13 Amount of Coak Deposited (mg) | | 221 | 200 | 256 | 280 | 326 |

*1Mineral oil I
Viscosity: 3.5 cSt at 100° C.; Viscosity Index: 100
*2Mineral oil II
Viscosity: 4.0 cSt at 100° C.; Viscosity Index: 100
*3Ethylene-α-olefin copolymer I
Number average molecular weight: 3,600; ethylene content: 70%
*4Ethylene-α-olefin copolymer II
Number average molecular weight: 2,600; ethylene content: 70%
*5Polymethacrylate I
Number average molecular weight: 120,000
*6Polymethacrylate II
Number average molecular weight: 28,000
*7Package DI
Antioxidant, detergent-dispersant (a mixture of calcium sulphonate, succinimide and ZnDTP)
*8Olefin copolymer
Number average molecular weight: 43,000; ethylene-propylene copolymer TABLE 1-continued

*9Kinematic viscosity
Measured according to JIS K2283.
*10CCS viscosity
Measured according to JIS K2215.
*11Supersonic shear stability test
Measured according to ASTM D-2603 (frequency: 10 KHz; amplitude: 28 μm; time: 30 minutes; oil amount: 30 ml)
*12HT/HS viscosity (TBS viscosity)
SAE Paper 830031 (temperature: 150° C.; shearing rate: $10^6$ $sec^{-1}$)
*13Panel coaking test
Measured according to Fed. Test Method 791 D-3462 (panel temperature: 300° C.; oil temperature: 160° C.; splash: 15 sec; pause: 60 sec; time: 3 hr)

The following can be understood from the results of Table 1.

In the examples of the present invention, shear stability is improved and HT/HS viscosity is increased. These results mean that the viscosity under high temperature and shear conditions is high and even when the oil is subjected to shear a decrease in viscosity is small. This demonstrates that the lubricating oil composition of the present invention is effective against the abrasion under high oil temperature conditions which is a problem encountered in a multi grade oil. Moreover, the panel deposit amount in the panel coaking test which is a measure of engine cleanliness is small.

TABLE 2

| | | Example | | Comparative Example | |
|---|---|---|---|---|---|
| | | 4 | 5 | 3 | 4 |
| Composition (wt %) | | | | | |
| Component (A) | Mineral oil II*1 | 79.7 | 83.5 | 44.2 | — |
| | Mineral oil III*2 | — | — | 44 | 90.0 |
| Component (B) | Ethylene-α-olefin copolymer I*3 | — | 7.0 | — | — |
| | Ethylene-α-olefin copolymer II*4 | 11.0 | — | — | — |
| | Ethylene-α-olefin copolymer III*5 | — | — | 2.5 | — |
| | Ethylene-α-olefin copolymer IV*6 | — | — | — | 0.7 |
| Component (C) | Polymethacrylate II*7 | 0.3 | 0.3 | 0.3 | 0.3 |
| Component (D-I) | Package DI*8 | 9.0 | 9.0 | 9.0 | 9.0 |
| Properties | | | | | |
| Kinematic Viscosity @ 100° C. (cSt)*9 | | 9.8 | 10.2 | 10.4 | 10.0 |
| CCS Viscosity @ −20° C. P*10 | | 32 | 31 | 30 | 32 |
| Supersonic Shear Stability Test*11 Rate of Reduction in Viscosity (%) @ 100° C. | | 0.4 | 0.6 | 4.2 | 13.0 |

*1Mineral oil II
Same as in Table 1
*2Mineral oil III
Viscosity: 5.4 cSt at 100° C.; Viscosity Index: 100
*3Ethylene-α-olefin copolymer I
Same as in Table 1
*4Ethylene-α-olefin copolymer II
Same as in Table 1
*5Ethylene-α-olefin copolymer III
Number average molecular weight: 10,000; ethylene content: 70%
*6Ethylene-α-olefin copolymer IV
Number average molecular weight: 40,000; ethylene content: 65%
*7Polymethacrylate II
Same as in Table 1
*8Package DI
Same as in Table 1
*9Kinematic viscosity
Measured according to JIS K2283.
*10CCS viscosity
Measured according to JIS K2215.
*11Supersonic shear stability test
Measured according to ASTM D-2603 (frequency: 10 KHz; amplitude: 28 μm; time: 30 minutes; oil amount: 30 ml)

EXAMPLES 6 TO 7 AND COMPARATIVE EXAMPLES 5 TO 11

The lubricating oil composition shown in Table 3 were subjected to various tests and their physical properties were evaluated.

The results are shown in Table 3.

TABLE 3

| | Example | | Comparative Example | | | | | | |
|---|---|---|---|---|---|---|---|---|---|
| | 6 | 7 | 5 | 6 | 7 | 8 | 9 | 10 | 11 |
| Composition (wt %) | | | | | | | | | |
| Component (A) Mineral Oil I*1 | 82.5 | 80.5 | 76.0 | 83.0 | 79.5 | 81.0 | 94.5 | 88.5 | 83.5 |
| Component (B) | | | | | | | | | |
| Ethylene-α-olefin copolymer I*2 | 13.0 | 6.5 | — | 13.0 | — | 2.0 | — | — | — |
| Ethylene-α-olefin copolymer II*3 | — | — | — | — | — | — | — | 7.0 | 3.5 |
| Component (C) | | | | | | | | | |
| Polymethacrylate A*4 | 0.5 | — | — | — | — | — | — | 0.5 | — |
| Polymethacrylate B*5 | — | 9.0 | 20.0 | — | — | 13.0 | — | — | 9.0 |
| Component (D-II)*6 | 3.5 | 3.5 | 3.5 | 3.5 | 3.5 | 3.5 | 3.5 | 3.5 | 3.5 |
| Additives*7 | 0.5 | 0.5 | 0.5 | 0.5 | 0.5 | 0.5 | 0.5 | 0.5 | 0.5 |
| Polybutene*8 | — | — | — | — | 16.5 | — | — | — | — |
| Ethylene-propylene copolymer*9 | — | — | — | — | — | — | 1.5 | — | — |
| Properties | | | | | | | | | |
| Kinematic Viscosity @ 40° C. cSt*10 | 98.75 | 87.94 | 93.84 | 97.59 | 88.97 | 90.34 | 89.88 | 94.10 | 87.92 |
| Kinematic Viscosity @ 100° C. cSt*10 | 15.34 | 14.99 | 16.46 | 14.95 | 12.62 | 15.21 | 14.71 | 15.02 | 14.98 |

TABLE 3-continued

| | | | | | | | | | |
|---|---|---|---|---|---|---|---|---|---|
| Viscosity Index*10 | 164 | 180 | 190 | 161 | 139 | 185 | 171 | 168 | 180 |
| Pour Point (°C.)*11 | −40.0 | −42.5 | −37.5 | −12.5 | −15.0 | −42.5 | −20.0 | −27.5 | −42.5 |
| Low Temperature Viscosity (centipoises)*12 | 150,000≧ | 150,000≧ | 150,000≧ | 1,000,000≦ | 1,000,000≦ | 150,000≧ | 1,000,000≦ | 150,000≦ | 150,000≧ |
| Four-Ball Test*13 | | | | | | | | | |
| LNL (Last Nonseizure Load) | 100 | 100 | 80 | 100 | 80 | 80 | 100 | 100 | 100 |
| WL (Weld Load) | 400 | 315 | 315 | 400 | 400 | 315 | 315 | 315 | 315 |
| LWI (Load Wear Index) | 62.3 | 56.0 | 49.4 | 59.1 | 54.8 | 49.8 | 53.3 | 55.1 | 55.8 |
| Supersonic Shear Stability Test*14 | 0.7 | 3.3 | 13 | 0.5 | 0.7 | 12 | 46.3 | 2.5 | 5.8 |
| Decrease in Viscosity at 100° C. (%) | | | | | | | | | |

*1Mineral oil
Viscosity: 4.03 cSt at 100° C.; Viscosity index: 98; pour point: −12.5° C.
*2Ethylene-α-olefin copolymer I
Oligomer of ethylene and α-olefin, hydrocarbon-based synthetic oil not containing a polar group; number average molecular weight: 3,600; viscosity: 2,000 cSt at 100° C.
*3Ethylene-α-olefin copolymer II
Oligomer of ethylene and α-olefin; number average molecular weight: 10,000; ethylene content: 70%
*4Polymethacrylate A
Polymethacrylate having a number average molecular weight of 62,000
*5Polymethacrylate B
Polymethacrylate having a number average molecular weight of 21,000
*6Super pressure agent
Butene sulfide and phosphoric acid ester amine salt
*7Additives
Amine-based antioxidant, a defoaming agent
*8Polybutene
Polybutene having a number average molecular weight of 2,000
*9Ethylene-propylene copolymer
Number average molecular weight: 100,000
*10Measured according to JIS K2283.
*11Pour point
Measured according to JIS K2269.
*12Low temperature viscosity
Brookfield viscosity (−26° C.), JPI 5S-26-85
*13Four-ball test
Measured according to ASTM D-2783
*14Supersonic shear stability test
Measured according to ASTM D-2603 (frequency: 10 KHz; amplitude: 28μ; time: 60 minutes; oil amount: 30 ml)

The following can be understood from the results of Table 3.

The lubricating oil compositions obtained in Examples 6 and 7 have a viscosity index of at least 140, a pour point of not more than −30° C. and a Brookfield viscosity at −26° C. of not more than 150,000 cp. Furthermore, the extreme pressure performance as determined by the Four ball test is superior to those of the comparative examples. Thus the lubricating oil compositions are satisfactory as a 80W/90 multi grade gear oil.

Comparative Example 5 is an example in which the component (B) is not used and as the component (C), polymethacrylate having a number average molecular weight of 21,000 which is most rarely subject to shear is used. This oil composition, however, is poor in shear stability and furthermore its extreme pressure performance is very low.

Comparative Example 6 is an example in which the component (C) is not used. This oil composition is poor in low temperature fluidity and thus cannot be used as a 80W/90 gear oil.

Comparative Example 7 is an example in which polybutene is used in place of the component (B). Even though a large amount of polybutene is used, the viscosity increasing effect can be obtained only insufficiently, and moreover low temperature fluidity is poor. Thus this oil composition cannot be used as a 80W/90 gear oil.

Comparative Example 8 is an example in which the proportion of the component (B) compounded is small. Although pour point is decreased, shear stability and extreme pressure properties are markedly poor.

Comparative Example 9 is an example in which the components (B) and (C) are not used and an ethylene-propylene copolymer having a number average molecular weight of 100,000 was used. This oil composition has a pour point of −20° C. and its shear stability is markedly poor.

Comparative Examples 10 and 11 are examples in which ethylene-α-olefin copolymer (oligomer) having a number average molecular weight of 10,000 is used in place of the component (B).

In Comparative Example 10, although shear stability is good, low temperature viscosity become undesirably high and thus this oil composition cannot be used as 80W/90 gear oil.

In Comparative Example 11, although low temperature viscosity is good, shear stability undesirably drops.

What is claimed is:

1. A lubricating oil composition comprising:

(A) a mineral oil having a kinematic viscosity at 100° C. of 0.5 to 50 centistokes and a viscosity index of at least 60, (B) 0.5 to 20% by weight based on the total weight of the composition of an ethylene-α-olefin copolymer having a number average molecular weight of 800 (inclusive) to 5,000 (exclusive), (C) 0.05 to 20% by weight based on the total weight of the composition of polymethacrylate having a number average molecular weight of 10,000 to 250,000 or a mixture of said polymethacrylate and an olefin copolymer, and (D-I) 1 to 20% by weight based on the total weight of the composition of a detergent-dispersant and/or an antioxidant.

2. The composition according to claim 1 wherein the component (A) is a mineral oil having a kinematic viscosity at 100° C. of 2 to 35 centistokes and a viscosity index of at least 80.

3. The composition according to claim 1 wherein the component (A) is a mineral oil having a pour point of not more than −5° C.

4. The composition according to claim 1 wherein the component (B) is an ethylene-α-olefin copolymer having a number average molecular weight of 2,000 to 4,000.

5. The composition according to claim 1 wherein polymethacrylate have a number average molecular weight of 20,000 to 200,000.

6. The composition according to claim 1 wherein the detergent-dispersant is at least one member selected from the group consisting of calcium sulphonate, magnesium sulphonate, phenate, salicylate, succinimide, acid amide, benzylamine and succinic acid ester.

7. The composition according to claim 1 wherein the antioxidant is phenol-based antioxidant, amine-based antioxidant or zinc dithiophosphate.

8. The composition according to claim 1 wherein the component (B) is compounded in a proportion of 1 to 15% by weight based on the total weight of the composition.

9. The composition according to claim 1 wherein the component (C) is compounded in a proportion of 0.1 to 10% by weight based on the total weight of the composition.

10. The composition according to claim 1 wherein the component (D-I) is compounded in a proportion of 3 to 15% by weight based on the total weight of the composition.

11. A lubricating oil composition comprising:

(A) a mineral oil having a kinematic viscosity at 100° C. of 1 to 50 centistokes and a viscosity index of at least 60, (B) 0.5 to 20% by weight based on the total weight of the composition of an ethylene-α-olefin copolymer having a number average molecular weight of 800 (inclusive) to 5,000 (exclusive), (C) 0.05 to 20% by weight based on the total weight of the composition of polymethacrylate having a number average molecular weight of 10,000 to 250,000 or a mixture of said polymethacrylate and an olefin copolymer, and (D-II) 0.5 to 20% by weight based on the total weight of the composition of at least one member selected from the group consisting of a extreme pressure agent, an anti-wear agent and an oiliness agent.

12. The composition according to claim 11 wherein the component (A) is a mineral oil having a kinematic viscosity at 100° C. of 1 to 40 centistokes and a viscosity index of at least 80.

13. The composition according to claim 11 wherein the component (A) is a mineral oil having a pour point of not more than −5° C.

14. The composition according to claim 11 wherein the component (B) is an ethylene-α-olefin copolymer having a number average molecular weight of 2,000 to 4,000.

15. The composition according to claim 11 wherein polymethacrylate have a number average molecular weight of 20,000 to 200,000.

16. The composition according to claim 11 wherein the extreme pressure agent is at least one member selected from the group consisting of sulfur-containing extreme pressure agent, phosphorus-containing extreme pressure agent, halogen-containing extreme pressure agent and organic metal-containing extreme pressure agent.

17. The composition according to claim 11 wherein the anti-wear agent is at least one member selected from the group consisting of organomolybdenum compound, organoboric compound and solid lubricant-based anti-wear agent.

18. The composition according to claim 11 wherein the oiliness agent is at least one member selected from the group consisting of higher fatty acid, higher alcohol, amine, ester and chlorinated fat and oil.

19. The composition according to claim 1 wherein the component (B) is compounded in a proportion of 3.0 to 15% by weight based on the total weight of the composition.

20. The composition according to claim 1 wherein the component (C) is compounded in a proportion of 0.1 to 15% by weight based on the total weight of the composition.

21. The composition according to claim 1 wherein the component (D-II) is compounded in a proportion of 0.5 to 10% by weight based on the total weight of the composition.

* * * * *